United States Patent [19]

Sturges

[11] 4,171,023

[45] Oct. 16, 1979

[54] TRIPLE TRACTOR ASSEMBLY

[75] Inventor: James R. Sturges, Washington, Ill.

[73] Assignee: Caterpillar Tractor Co., Peoria, Ill.

[21] Appl. No.: 901,039

[22] Filed: Apr. 28, 1978

[51] Int. Cl.[2] ..... E02F 3/76

[52] U.S. Cl. ..... 172/801; 172/292; 180/9.2 R; 180/14 R

[58] Field of Search ..... 180/9.2 R, 14; 272/292, 272/801, 803, 804, 136

[56] References Cited

U.S. PATENT DOCUMENTS

| | | | |
|---|---|---|---|
| 2,113,997 | 4/1938 | Star | 172/292 |
| 3,040,510 | 6/1962 | Lely | 172/292 |
| 3,245,488 | 4/1966 | Peterson | 180/14 R |
| 3,601,210 | 8/1971 | Stedman | 180/14 R |
| 3,661,214 | 5/1972 | Peterson | 172/801 |
| 4,053,021 | 10/1977 | Sturges | 180/14 |
| 4,086,975 | 5/1978 | Nystuen | 180/14 R |

FOREIGN PATENT DOCUMENTS

| | | | |
|---|---|---|---|
| 339845 | 12/1930 | United Kingdom | 180/9.2 |

*Primary Examiner*—Richard J. Johnson
*Attorney, Agent, or Firm*—Charles E. Lanchantin, Jr.

[57] ABSTRACT

First and second tractors are connected by a coupling device in a first row, and a third tractor is disposed in substantially parallel relation thereto in a juxtaposed second row. An implement assembly is connected to one of the first and second tractors and to the third tractor for moving material obliquely away from the normal longitudinal direction of working movement of the tractors. Preferably, a second implement assembly is connected to the other one of the first and second tractors and to the third tractor for similar operation when the triple tractor assembly travels in a reverse direction as a unit.

11 Claims, 1 Drawing Figure

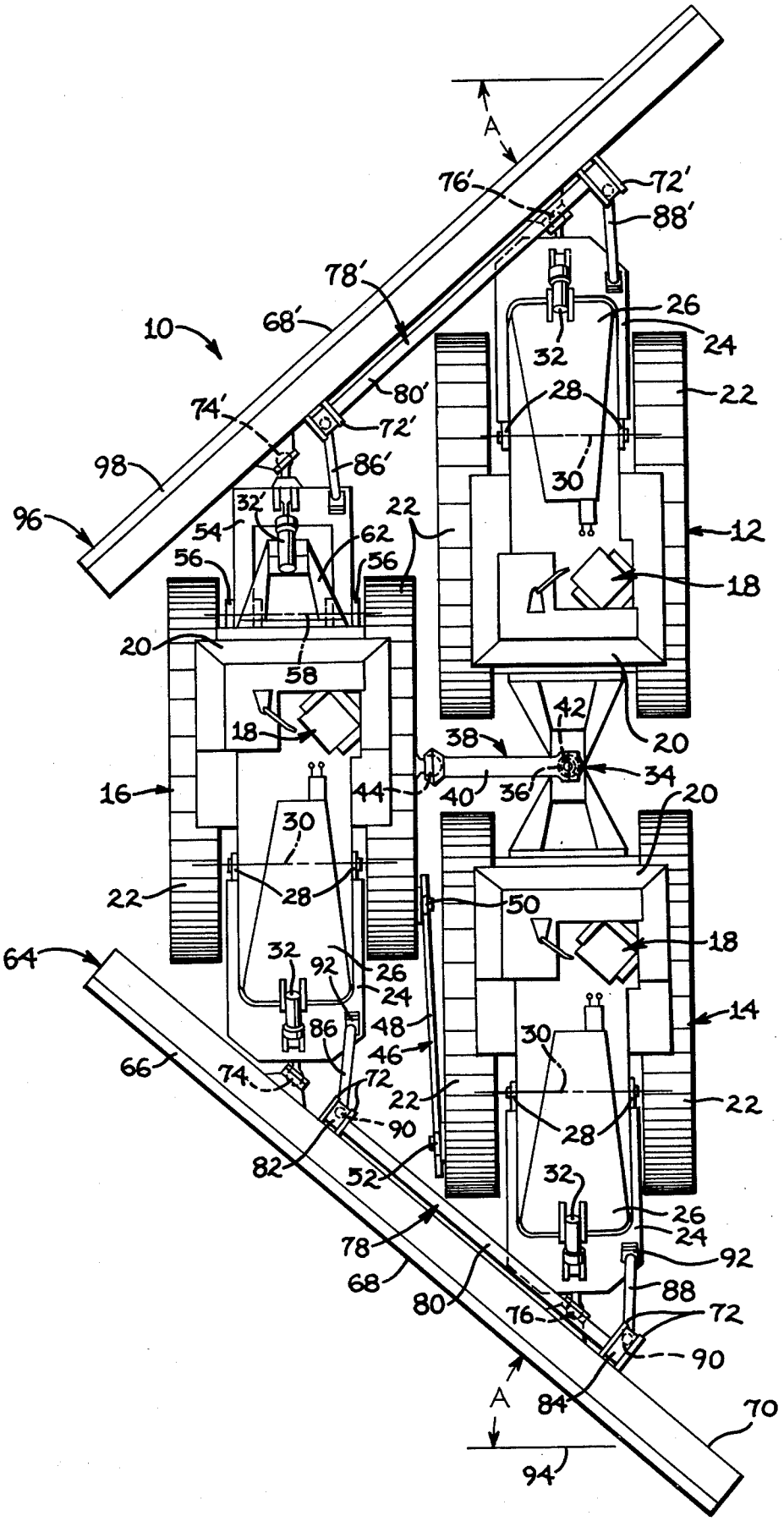
A
76'
72'
88'
78'
26
10
68'
24
32
80'
22
28
74'
72'
98
86'
30
96
32'
22
12
54
62
56
56
18
20
58
42
18
38
20
16
44
40
36'
34
20
30
22
28
50
64
32
92
26
18
24
14
86
48
30
66
74
46
72
22
22
90
28
82
52
32
26
24
78
92
68
88
80
76
72
90
A
84
70
94

TRIPLE TRACTOR ASSEMBLY

BACKGROUND OF THE INVENTION

This invention relates to a tractor assembly, and more particularly to a unitary assembly of at least three tractors and an implement for moving earth or the like.

There is an increasing demand for moving large volumes of overburden such as in strip mining, and this need is currently being met with the largest forms of earthmoving equipment and with dual or tandem operated vehicles. For example, two crawler tractors have been coupled to each other in side-by-side relation for powering a single bulldozer blade. In such instance, the individual tractors are smaller than an equivalently powered single tractor, and they can be disengaged from each other and the implement for separate use, easier maintenance, and easier shipping purposes.

However, with a single bulldozer blade spanning between the front of two tractors, it is difficult to vary the position of the blade because of the length limitations of the extensible and retractable hydraulic jacks connected thereto, and to obtain the desired angularity of the blade relative to the normal forward direction of longitudinal movement. Specifically, it is difficult to angle the blade sufficiently to optimize side casting of the overburden. Moreover, when the blade is positioned for maximized side casting ability, the leading edge requires more tractive effort or drawbar pull of the tractor on that side.

Still another problem resides in the fact that when the aforementioned side casting side-by-side tractor assemblies reach the end of a long row they often must be operated in reverse back to the start of the row without moving earth in order to continue to cast material in a single direction. It can be appreciated that it would be a waste of labor and time to manually disconnect linkage between the tractors and the blade in order to side cast material to the same side.

In the case of using tractors in tandem, with one tractor situated behind the other and coupled thereto through a pivotable coupling, it is recognized that the tractive base of assembly is as narrow as a single tractor and there is little gain in stability with respect to lateral forces. Hence, when a wide bulldozer blade is connected to the tandem tractors high off-center forces tend to pivot one tractor about the other. Furthermore, the lead tractor provides the sole support and manipulative function of the blade with attendant complications such as having undesirable moment arms, for example.

SUMMARY OF THE INVENTION

The present invention is directed to overcoming one or more of the problems as set forth above.

According to the present invention, this is accomplished by providing first, second and third tractors, a coupling device for connecting the first and second tractors in an elongated first row with the third tractor disposed in a substantially parallel and juxtaposed second row, and an implement assembly connected to one of the first and second tractors and to the third tractor for moving earth or the like obliquely away from the normal longitudinal direction of working movement of the tractors.

Preferably, a second implement assembly is connected to the other one of the first and second tractors and to the third tractor for moving earth in the same side casting direction as the first implement assembly in response to reversing movement of the tractor assembly.

BRIEF DESCRIPTION OF THE DRAWING

The sole FIGURE of the drawings is a diagrammatic plan view of a preferred embodiment triple tractor assembly constructed in accordance with the present invention.

DETAILED DESCRIPTION

As shown in the drawing, a triple tractor assembly 10 includes first, second and third crawler tractors 12, 14 and 16, respectively with each being oriented in the normal longitudinal direction of working movement. Each of the crawler tractors is of the usual type, such as having an operator's station 18 on a rear portion 20 thereof and a pair of supporting and driving undercarriage assemblies 22 on the opposite sides thereof. Furthermore, each of the tractors has a C-shaped push frame 24 coupled to a front portion 26 thereof. The push frames are connected to their respective tractors by pairs of pivot joints 28 arranged on a transverse axis 30 so that they can pivot in generally vertical planes about these axes. Each of the push frames are raised and lowered by a reciprocable lift jack 32 connected between the front of the push frame and the top front portion of the tractor in a conventional manner.

More particularly, the first tractor 12 and the second tractor 14 are connected in tandem in back-to-back relation by coupling means or a coupling device 34. Preferably, such coupling means includes a ball and socket joint or ball joint 36 having members connected to the respective rear portions 20 so that the tractors 12 and 14 can assume some misalignment or relative angularity as the tractor assembly 10 transverses as a unit over uneven terrain. As thus connected, however, the first and second tractors are arranged in a longitudinally elongated first row. It is evident from the drawing that the third tractor 16 is arranged in a longitudinally foreshortened second row that is substantially parallel and adjacent the first row, and substantially longitudinally centered with respect to the first row.

The third tractor 16 is transversely stabilized with respect to the first and second tractors 12 and 14 by cross bracing means 38. Preferably, the cross bracing means includes a rigid cross brace 40 pivotally connected to the coupling means 34 as at another ball and socket joint or ball joint 42 and pivotally connected to the inside undercarriage assembly 22 of the third tractor, as at a ball joint 44. Preferably, further, the ball joint 42 is located elevationally directly above the ball joint 36.

Moreover, the third tractor 16 is longitudinally interconnected or stabilized with respect to the first and second tractors 12 and 14 by link means 46. Such link means preferably includes a rigid link 48 connected to the inside undercarriage assembly 22 of the third tractor 16 at a pivot joint 50 and to at least one of the inside undercarriage assemblies 22 of the tractors 12 and 14. In the embodiment illustrated, the other end of the link 48 is connected to the front end of the inside undercarriage assembly of the second tractor 14 as at a pivot joint 52.

Referring now to the rear portion 20 of the third tractor 16, it may be noted that another C-shaped push frame 54 is secured thereto at a pair of opposite pivot joints 56 so that the rear part of that push frame may be elevated about a transverse axis 58 through those joints.

For such purpose an extendible and retractable lift jack 32' is pivotally connected to a rearwardly leaning support structure 62 on the rear portion of the tractor and to the push frame.

As noted in the lower portion of the drawing, implement means or an implement assembly 64 is connected solely to the push frames 24 at the front ends of the second and third tractors 14 and 16, respectively. The implement means preferably includes an elongated or very large bulldozer blade 66 which is angled in a preselected manner with respect to the normal longitudinal direction of working movement of the triple tractor assembly 10. Specifically, the blade has a front working surface 68, a rear surface 70, two pairs of spaced apart mounting brackets 62 which extend rearwardly from the rear surface, and a laterally spaced pair of ball joints 74 and 76 connecting the blade respectively to the push frames 24 of the third tractor 16 and second tractor 14.

Advantageously, a torsion bar assembly 78 holds the bulldozer blade 66 in a generally upright working position with but minor change in pitch irrespective of the lateral or longitudinal oscillations of the second tractor 14 relative to the third tractor 16. The torsion bar assembly includes a torsion bar rod 80 which extends through the mounting brackets 72 and yet is revolvable therein. A pair of short levers 82 and 84 extend radially from the opposite ends of the torsion bar rod and form an angle of about 90° with respect to each other relative to viewing along the axis of the torsion bar rod. A pair of links 86 and 88 are respectively connected to the opposite ends of the short levers 82 and 84 as at a pair of ball joints 90 and extend downwardly to the push frames to a pair of ball joints 92. Such torsion bar assembly and it operation on a pair of side-by-side tractors is set forth in more detail in U.S. Pat. No. 3,661,214 issued May 9, 1972 to R. A. Peterson, et al, and assigned to the assignee of the present invention.

In accordance with one aspect of the invention, the front working surface 68 of the bulldozer blade 66 is so mounted on the triple tractor assembly 10 as to be angularly inclined at a preselected optimum side casting angle A with respect to a transverse plane 94. Preferably, such angle A is in a range of from 30 to 50 degrees, and preferably about 40°. This is achieved primarily by locating the third tractor 16 in a preselected longitudinal and lateral position relative to the first tractor 12 and second tractor 14. Specifically, the longitudinal midpoint of the third tractor is substantially laterally aligned with the coupling means 34 between the first and second tractors. Note, for example, that the cross bracing means 38 extends substantially solely transversely between the coupling means 34 and the ball joint 44 located about at the longitudinal midpoint of the third tractor.

In accordance with another aspect of the invention, a second implement means or second implement assembly 96 is preferably mounted on the other end of the triple tractor assembly 10. The second implement means includes a second bulldozer blade 98 and associated mounting structure therefor which are substantially identical to those described above with respect to the first bulldozer blade 66 and its mounting structure and, accordingly, identical reference numerals with a prime designation have been appended thereto to designate similar elements. With such mounting of the second bulldozer blade on the push frames 24 and 54, the side casting angularity of the working surface 68' is advantageously again established at the preselected angle A, or about 40° with respect to a transverse plane.

Operation

Assuming initially that the second bulldozer blade 98 at the top of the drawing is elevated above the ground by retracting the jacks 32 and 32' associated with the first tractor 12 and the third tractor 16, and that the first bulldozer blade 66 is lowered into working relation to the earth by extending the other jacks 32 to the desired degree of extension, the tractors 12, 14 and 16 are all powered so that they move as an integral unit in a first or downward longitudinal direction relative to the drawing. Even though the leading portion of the blade 66 is experiencing the greatest working forces as material is pushed up by the blade, these forces are resisted primarily by the combined tractive effort of both of the first and second tractors 12 and 14 working through the leading ball joint 76. The trailing ball joint 74, on the other hand, needs only to resist a lesser working force on the trailing portion of the blade and this is desirably achieved substantially by the tractive effort of the single tractor 16.

Material is side casted to the left when viewing the drawing until the end of the row is reached whereupon, without turning the tractor assembly 10 around, the first bulldozer blade 66 is raised and the second bulldozer blade 98 is lowered at the top of the drawing. At this point, all three tractors 12, 14 and 16 can be controllably shifted into a reverse mode of operation so that the tractor assembly travels upwardly when viewing the drawing. With such movement, material is side cast to the left or to the same side as before. This is particularly advantageous for large volume strip mining reclamation work, for example, since the return trip is not lost time. Since some spoil banks are several miles long, this is a major improvement.

Minor changes in the pitch of the blades 66 and 98 are, of course, conveniently achieved by controlled extension or retraction of one of the lift jacks 32 relative to its laterally associated lift jack on the adjacent tractor.

Other aspects, objects and advantages of this invention can be obtained from a study of the drawings, the disclosure and the appended claims.

The embodiments of the invention in which an exclusive property or privilege is claimed are defined as follows:

1. A triple tractor assembly (10) comprising:

first, second and third tractors (12,14,16) each having a normal longitudinal direction of working movement, said third tractor (16) having a side joint (44);

first means (34) for connecting said first and second tractors (12,14) in a longitudinally elongated first row; and second means (38) for laterally connecting said side joint (44) of said third tractor (16) to one of said first and second tractors (12,14) at said first means (34), said third tractor (16) being arranged in a longitudinally forshortened second row substantially parallel to and adjacent said first row, and substantially longitudinally centered with respect to said first row.

2. The triple tractor assembly (10) of claim 1 including third means (46) for connecting said third tractor (16) to at least one of said first and second tractors (12,14), said third means (46) including a rigid link (48) having a substantial longitudinal orientation.

3. The triple tractor assembly (10) of claim 1 including first implement means (64) for moving material obliquely away from said longitudinal direction connected to one of said first and second tractors (12,14) and to said third tractor (16), and second implement means (96) for moving material obliquely away from said longitudinal direction, said second implement means (96) being connected to the other one of said first and second tractors (12,14) and to said third tractor (16).

4. The triple tractor assembly (10) of claim 3 wherein each of said first and second implement means (64,96) includes a bulldozer blade (66,98) angularly inclined at a preselected side casting angle.

5. The triple tractor assembly (10) of claim 1 wherein each of said first and second tractors (12,14) has a rear portion (20), and said first means (34) connects said rear portions (20).

6. A triple tractor assembly (10) comprising:

first, second and third tractors (12,14,16), each of said first and second tractors (12,14) having a rear portion (20);

first means (34) for longitudinally connecting said rear portion (20) of said first tractor (12) to said rear portion (29) of said second tractor (14) in a first row;

second means (38/46) for connecting said third tractor (16) to one of said first and second tractors (12,14) in a second row; and first and second implement means (64,96) mounted on said tractors (12,14,16) for moving material obliquely toward a single side thereof, said first implement means (64) functioning during movement of the tractors (12,14,16) in one direction and said second implement means (96) functioning during movement thereof in an opposite direction.

7. The triple tractor assembly (10) of claim 6 wherein said first means (34) includes a ball and socket joint (36) connected between said first and second tractors (12,14).

8. The triple tractor assembly (10) of claim 7 wherein said second means (38/46) includes a transversely oriented brace (40) connected between said third tractor (16) and one of said first and second tractors (12,14) generally at said ball and socket joint (36).

9. The triple tractor assembly (10) of claim 6 wherein said third tractor (16) includes a side joint (44), and said second means (38/46) includes a cross brace (40) connected to and extending substantially transversely from said side joint (44).

10. The triple tractor assembly (10) of claim 6 wherein said second means (38/46) includes a rigid link (48) having a generally longitudinal orientation.

11. The triple tractor assembly (10) of claim 6 including first, second, third and fourth C-shaped push frames (24,24,24,54), said first push frame (24) being connected to said first tractor (12) and said second implement means (96), said second push frame (24) being connected to said second tractor (14) and said first implement means (64), said third push frame (24) being connected to said third tractor (16) and said first implement means (64), and said fourth push frame (54) being connected to said third tractor (16) and said second implement means (96).

* * * * *